United States Patent [19]

Fuchs et al.

[11] Patent Number: 4,978,361

[45] Date of Patent: Dec. 18, 1990

[54] ECONOMY CHROME TANNING

[75] Inventors: Karlheinz Fuchs, Hünfelden; Norbert Münch, Kelkheim, both of Fed. Rep. of Germany

[73] Assignee: Hoechst Aktiengesellschaft, Frankfurt am Main, Fed. Rep. of Germany

[21] Appl. No.: 343,010

[22] Filed: Apr. 25, 1989

[30] Foreign Application Priority Data

Apr. 27, 1988 [DE] Fed. Rep. of Germany ..... 3814220

[51] Int. Cl.[5] ..... C14C 3/02; C14C 3/04

[52] U.S. Cl. ..... 8/94.27; 8/94.18; 8/94.19 R

[58] Field of Search ..... 8/94.18, 94.21, 94.15, 8/94.27

[56] References Cited

U.S. PATENT DOCUMENTS 4,042,321 8/1977 Bäcker et al. ..... 8/94.26

4,715,861 12/1987 Lotz et al. ..... 8/94.18

*Primary Examiner*—Paul Lieberman

*Assistant Examiner*—John F. McNally

[57] ABSTRACT

Process for economy chrome tanning, which comprises pretreating the pelt prior to tanning with 0.5 to 2% by weight, preferably 0.7 to 1,2% by weight, of an aldehyde- or keto-carboxylic acid, tanning in a conventional manner and then finish-tanning with 2 to 4.5% by weight of a mixture of a chromium(III) salt, an acid-binding agent and an aromatic di- or tricarboxylic acid or a salt thereof.

5 Claims, No Drawings

ECONOMY CHROME TANNING

DESCRIPTION

Chrome tanning is an essential operation in leather-making. In conventional processes, leather that is resistant to the boiling test is obtained by making available chromium salts in a concentration corresponding to an equivalent of 2 to 2.5% by weight of $Cr_2O_3$ based on pelt weight. However, of this amount only 70 to 80% is in fact permanently fixed in the hide, so that 20 to 30% of the chrome tannin ends up in the effluent.

For economic and ecological reasons there has therefore been no shortage of past attempts to improve chromium fixation in the hide and to reduce the amount of chromium necessary for boil-resistant tanning.

For instance, by raising the pH of the tanning liquor above the usual level, it is possible to improve the exhaustion of the chrome tannins. However, the simultaneously increased adstringence of the chrome tannins leads to wrinkled grain, i.e. qualitatively inferior leathers. Usually there is also a loss of surface area.

Furthermore, improved exhaustion of the chrome tannins can be obtained by raising the temperature of tanning liquors from the usual 38 to 40° C. to about 45° C. However, the temperature increase likewise produces an increase in the adstringence of the chrome tannins, so that here too there is a danger of wrinkled grain and loss of yield, i.e. reduced leather quality.

The literature also discloses using aromatic di- and tricarboxylic acids, for example phthalic acid and/or their salts in pickling or chrome tanning in order to obtain better fixation of the chromium in the hide. However, if they are used in the pickle, they produce a distinct reduction in the penetration rate of subsequent chrome tannings, a non-uniform distribution of the chrome and, in the case of thicker, unsplit pelts, in some cases even an insufficient degree of tanning. If they are to be used in chrome tanning, it is usually necessary, to reduce these defects, to carry out the tanning in two stages by performing a mild pretanning at a low pH with usually organically maskd chromium(III) sulfate tannin, which is then followed by the addition of the aromatic di- and tricarboxylic acids alone or in the presence of further chrome tannins and/or a basifying agent.

The prior art also discloses an economy chrome tannin process (U.S. 4,715,861) where 0.1 to 2% by weight of an aldehyde- or keto-carboxylic acid, preferably glyoxylic acid, is used in the pickling bath prior to tanning as partial or complete replacement for the customarily used sulfuric acid or formic acid. The chrome tanning is carried out in the same bath. This process produces very soft leathers having a tight grain and improved physical properties. It is true that the exhaustion of chrome tanning liquors is distinctly improved, but it does not meet the increased demands in all cases.

In another known process (U.S.4,042,321), the conventionally pickled pelts are pretanned with chromium(III) salts and finish-tanned with a mixture of chromium(III) salts, acid-binding agents (dolomite, MgO, alkali metal and alkali earth metal carbonates and/or bicarbonates) and aromatic di- and tricarboxylic acids (phthalic acid, isophthalic acid, succinic acid and the like), their salts or anhydrides. This process gives a very good exhaustion of the chrome tanning liquors. However, the leathers obtained usually suffer from poor dye-ability, coarse grain and poor yield.

The present invention provides a process for economy chrome tanning where prior to tanning the pelts are pretreated with 0 5 to 2% by weight, preferably 0.7 to 1.2% by weight, of an aldehyde- or keto-carboxylic acid, tanned in a conventional manner and then finish-tanned with 1 to 4.5% by weight, preferably 1 to 3% by weight, of a mixture of chromium(III) salts, acid-binding agents and aromatic di- or tricarboxylic acids or salts thereof.

The aldehyde- or ketone-acid is preferably glyoxylic acid or even pyruvic acid. The pretreatment with these acids takes place from an aqueous liquor at the above-mentioned concentrations. This pretreatment may be carried out separately, but advantageously it is combined with pickling. The combination with pickling also has the advantage that the addition of the acid mentioned to the pickling bath makes it unnecessary to use the customarily included masking acids such as formic acid or acetic acid. The pickling bath otherwise contains the customary pickling acids and salts in the customary concentrations, for example from 0.1 to 2% by weight of sulfuric acid (90% strength). This pretreatment takes in general 0.5 to 20 hours.

The subsequent chrome tanning takes place with the customarily commercially available chromium(III) tannins in a conventional manner.

The available chromium, based on the pelt weight, is here in general 0.8 to 1.5% by weight. The tanning time is about 30 to 180 minutes. Suitable chromium(III) salts for the tanning are the customary chromium(III) salts usable for chrome tanning, in particular chromium(III) sulfates, basic chromium(III) sulfates, and also chromium(III) salts masked with organic acids, for example formic acid or acetic acid, self-basifying chrome tannins, which, in addition to chromium(III) salts contain inorganic salts, such as sodium sulfate, or reaction products of 6-valent chromium compounds with reducing agents.

The actual tanning is followed by a finish-tanning by treatment with an aqueous solution which contains chromium(III) salts, acid-binding agents and aromatic di- or tricarboxylic acids or salts thereof.

In the finish-tanning mixtures, the chromium(III) salts used are preferably chromium sulfates and basic chromium sulfates. It is also possible to use masked chromium(III) salts, in particular chromium(III) sulfates which advantageously show only a small degree of masking.

Suitable acid-binding agents are, for example, dolomite, alkali metal carbonates and bicarbonates, alkaline earth carbonates and bicarbonates, magnesium oxide and sodium sulfite.

The dolomite used is the mineral double salt $CaCO_3 \cdot MgCo_3$, which contains 20 to 40% of CaO, preferably 25 to 35% of CaO, and 10 to 25% of MgO, preferably 16 to 24% of MgO. The dolomite can be used either by itself or combined with other acid-binding substances, in which case the dolomite content of the mixtures should preferably be not less than 10% of the total amount of acid-binding agents.

Particularly suitable mixtures contain 10 to 130% by weight of dolomite per 100% by weight of $Cr_2O_3$. The amount of dolomite to be used depends on the basicity of the chromium(III) salts used, on the basicity to which these chromium(III) compounds are to be brought in the course of tanning, on the basicity and the amount of chromium(III) salts used in the pretanning, and on the amount of any further acid-binding substances included in the mixture.

Aromatic dicarboxylic acids and tricarboxylic acids having 8 to 13 carbon atoms are those of the benzene and naphthalene series which, in addition to the carboxyl groups, may also contain hydroxyl, amino or nitro groups and/or halogen atoms. Preference is given to using phthalic acid and isophthalic acid. Aromatic diand tricarboxylic acids which, in addition to the carboxyl groups, also contain sulfonic acid groups may only account for up to about one third of the total amount of carboxylic acid used.

The carboxylic acids can be used not only in the form of free acids or in the form of mixtures of free acids and the salts of such carboxylic acids but also in the form of the salts alone, advantageously the alkali metal salts. Preference is given to using pulverulent mixtures of the free carboxylic acids and the salts thereof in a molar ratio of 60:40 and 40:60.

The finish-tanning advantageously takes place in the same bath on addition of the mixtures in powder form. The components of the claimed mixtures can preferably be added conjointly. It is also possible to add only some of these components conjointly or each of them separately. Advantageously, the basic chromium(III) salts are added first alone or together with other components. These chromium(III) salts can also be added together with the chromium(III) salts used for the pretanning.

The amounts to be used of the mixtures are such that the total amount of $Cr_2O_3$ made available in the preand finish-tanning is 1.2 to 2%, in particular 1.5 to 1.8%, of $Cr_2O_3$, based on pelt weight, and that the aromatic di- and/or tricarboxylic acids of 8–14 carbon atoms and/or the salts thereof amount to at least 1.0 mole per mole of chromium oxide of total chrome tannin used not only for the pretanning but also for the finish-tanning.

The finish-tanning is effected at temperatures of about 36–45° C. with a liquor in a liquor ratio of less than 100%, preferably 10 to 50%, based on pelt weight. The tanning is carried out in such a way that at the end of the tanning the liquor has a pH of about 3.6, in particular 3.9 to 4.5. The finish-tanning takes approximately 7 to 12 hours.

The above-described procedure is advisable in particular for thinner pelts. In the case of thicker pelts, it is advantageous to add a portion of the mixture of chromium(III) salts, acid-binding agents and aromatic di- or tricarboxylic acids to the pickling bath prior to pretanning. The concentration here is about 0.5 to 2.5% by weight, preferably 0.5 to 1.5% by weight, based on pelt weight. The remainder of this mixture, about 1.5 to 2% by weight, is then used for the finish-tanning as described above. All the operations described can be carried out in the same bath, but it is also possible to split them into a plurality of separate steps.

The leather obtained by these processes is resistant to the boiling test, soft, firm-grained, extremely finely grained and readily dyeable with excellent physical properties and good yield. The level of chromium oxide in the residual tanning liquor is extremely low.

EXAMPLE 1

| Pelt, unsplit | | |
|---|---|---|
| Pickling bath | 50.0% of water 25–27° C. | 10 min |
| | 6.0% of sodium chloride 6–7.5° Be | |
| + | 0.2% of sulfuric acid 96% | 30 min |
| + | 1.0% of glyoxylic acid pH 3.5–4.0 | 90 min |
| + | 0.75% of mixture of chromium (III) salts, acid binding agents and Na salt of terephthalic acid as described in Example 6 of DE-C 2,424,300 once the pelt has been completely penetrated (in section) | 90 min |
| + | 4.0% of chromium sulfate, 33% basic, 24–26% of $Cr_2O_3$ | 2–3 hours |
| | once the chrome has completely penetrated, (1.25% of above chromium salt mixture) raise temperature to 42–45° C. | 5–8 hours |
| | Final temperature = 42–45° C. | |
| | Final pH = 4.2–4.5 | |
| | $Cr_2O_3$ content of residual decay = 45–60 mg/l | |
| | $Cr_2O_3$ content of leather (0% of $H_2O$) = 4.0–4.4% | |

EXAMPLE 2

| Pelt, unsplit | | |
|---|---|---|
| Pickling bath | 45.0% of water 25–27° C. | 10 min |
| | 6.0% of sodium chloride 6–7.5° Be | |
| + | 0.2% of sulfuric acid 96% | 30 min |
| + | 1.0% of glyoxylic acid pH 3.5–4.0 | 90 min |
| + | 1.5% of mixture of chromium (III) salts, acid binding agents and Na salt of terephthalic acid as described in Example 6 of DE-C 2,424,300 once the pelt has been completely penetrated (in section) | 60–90 min |
| + | 4.0% of chromium sulfate, 33% basic, 24–26% of $Cr_2O_3$ once the chrome has completely penetrated, | 2–3 hours |
| | 1.5% of above chromium salt mixture Raise temperature to 42–45° C. | 5–8 hours |
| | Final temperature = 42–45° C. | |
| | Final pH = 4.2–4.5 | |
| | $Cr_2O_3$ content of residual decay = 70–85 mg/l | |
| | $Cr_2O_3$ content of leather (0% of $H_2O$) = 4.0–4.4% | |

EXAMPLE 3

| Pelt, split to 2.0–2.5 mm | | |
|---|---|---|
| Pickling bath | 45.0% of water 25–27° C. | 10 min |
| | 6.0% of sodium chloride 6–7.5° Be | |
| + | 0.2% of sulfuric acid 96% | 30 min |
| + | 1.0% of glyoxylic acid pH 3.5–4.0 | 60–90 min |
| + | 4.0% of chromium sulfate, 33% basic, 24–26% of $Cr_2O_3$ | 60–90 min. |
| + | 2.0% of mixture of chromium (III) salts, acid-binding agents and aromatic dicarboxylic acids or salts thereof as in Example 11 of DE-C-2,424,300 | 6–9 hours |
| | Raise temperature to 42–45° C. | |
| | Final temperature = 42–45° C. | |
| | Final pH = 4.2–4.5 | |

-continued

| Pelt, split to 2.0–2.5 mm |
|---|
| $Cr_2O_3$ content of residual decay = 60–70 mg/l |
| $Cr_2O_3$ content of leather (0% of $H_2O$) = 4.0–4.4% |

EXAMPLE 4

| Pelt split to 2.0–2.5 mm, delined for 4–8 hours | | |
|---|---|---|
| Pickling bath | 45.0% of water 25–27° C. | 10 min |
| | 6.0% of sodium chloride 6–7.5° Be | |
| + | 0.2% of sulfuric acid 96% | 30 min |
| + | 1.0% of glyoxylic acid pH 3.5–4.0 | 60–90 min |
| + | 0.5% of mixture of chromium (III) salts, acid binding agents and phthalic acid and the Na salt thereof as described in Example 1 of DE-C-2,424,300 once the pelt has been completely penetrated (in section) | 60–90 min |
| + | 4.0% of chromium sulfate, 40% basic, 24–26% of $Cr_2O_3$ | 60–90 min |
| | 0.5% of above chromium salt mixture | 5–8 hours |
| | Raise temperature to 42–45° C. | |
| | Final temperature = 42–45° C. | |
| | Final pH = 4.0–4.4 | |
| | $Cr_2O_3$ content of residual decay = 55–70 mg/l | |

-continued

| Pelt split to 2.0–2.5 mm, delined for 4–8 hours |
|---|
| $Cr_2O_3$ content of leather (0% of $H_2O$) = 3.9–4.3% |

We claim:

1. A process for economy chrome tanning, which comprises:

pretreating a pelt prior to tanning with 0.5 to 2.0% by weight, of an aldehyde- or keto- carboxylic acid, together with pickling in a pickling bath, adding to the pickling bath 0.5 to 2.5% by weight, based on pelt weight of a mixture of chromium (III) salt, acid binding agents and aromatic di- or tricarboxylic acid, tanning in a conventional manner; and finish-tanning with 1.5 to 2% by weight, of the mixture of a chromium (III) salt, acid-binding agents, and aromatic di- tricarboxylic acid.

2. The process as claimed in claim 1, wherein the pelt is pretreated with glyoxylic acid.

3. The process as claimed in claim 1, wherein the pelt is treated with a mixture of a chromium(III) salt, dolomite and phthalic acid or sodium phthalate.

4. A process as claimed in claim 1 wherein said pretreating step utilizes 0.7 to 1.2% by weight, of an aldehyde-or keto-carboxylic acid.

5. A process as claimed in claim 1 wherein said pickling step utilizes 0.5 to 1.5% by weight, based upon pelt weight, of a mixture of chromium (III) salt, acid-binding agents and aromatic di- or tricarboxylic acid.

* * * * *